United States Patent [19]

Snyder

[11] 4,112,542

[45] Sep. 12, 1978

[54] AUXILIARY HANDLE FOR PLURALITY OF CARRYING HANDLES

[75] Inventor: John M. Snyder, 186 Riverside Dr., New York, N.Y. 10024

[73] Assignees: John M. Snyder; Bernard J. Steinberg, both of New York, N.Y.; Edward Halle, Fort Lauderdale, Fla.

[21] Appl. No.: 823,719

[22] Filed: Aug. 11, 1977

[51] Int. Cl.[2] ..... A45C 13/22

[52] U.S. Cl. ..... 16/114 R; 190/57; 224/52

[58] Field of Search ..... 16/110 R, 114 R; 150/12; 190/57, 55 A; 224/50, 52, 55

[56] References Cited

U.S. PATENT DOCUMENTS

| | | | |
|---|---|---|---|
| 1,020,722 | 3/1912 | Somerville | 16/114 R |
| 1,246,587 | 11/1917 | Giardino | 16/114 R |
| 1,429,446 | 9/1922 | Morgan | 16/114 R |
| 1,460,554 | 7/1923 | Moore | 16/114 R |
| 1,658,174 | 2/1928 | Russell | 190/57 |
| 1,671,812 | 5/1928 | Chase | 16/114 R |
| 1,753,396 | 4/1930 | Witkowski et al. | 16/114 R |
| 2,312,256 | 2/1943 | Lumley | 16/114 R |

*Primary Examiner*—Louis K. Rimrodt
*Attorney, Agent, or Firm*—Edward Halle

[57] ABSTRACT

An auxiliary handle for a plurality of carrying handles which has a carrying handle in the main body portion and a plurality of wing-like, foldable auxiliary handle holding or carrying elements which are foldable toward the auxiliary carrying handle and foldable outwardly so as to hold the primary handles of suitcases or other items to be carried, whereby the user may carry in one hand two or more items being held or depending from the foldable handle holding elements.

11 Claims, 11 Drawing Figures

Fig. 5
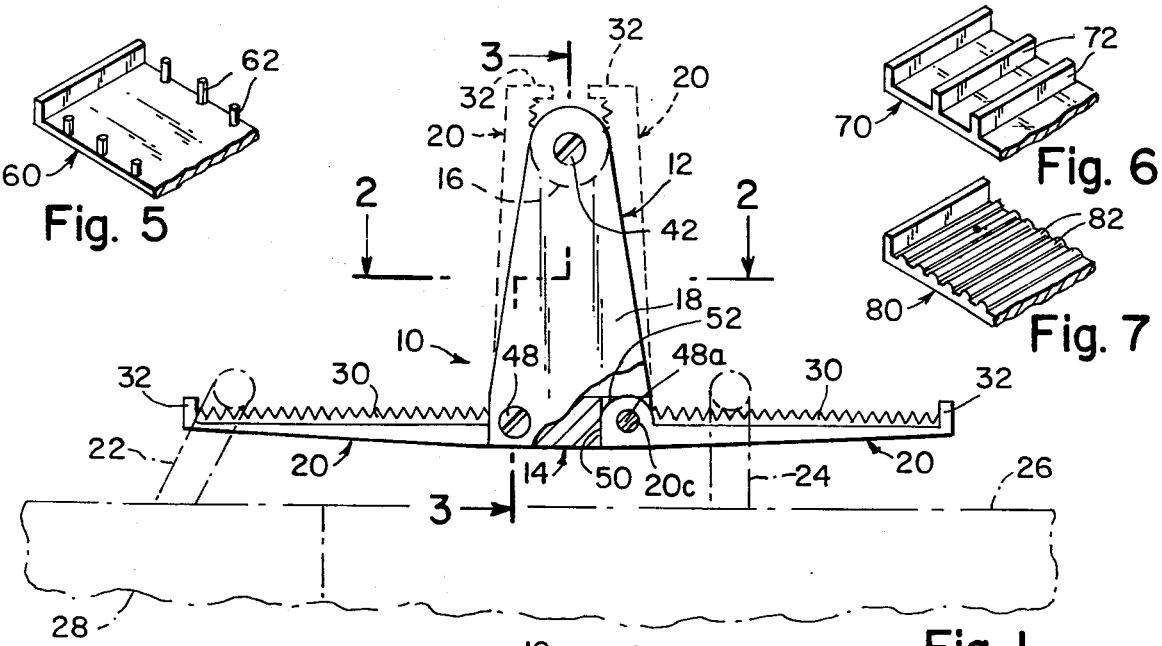
Fig. 1
Fig. 6
Fig. 7
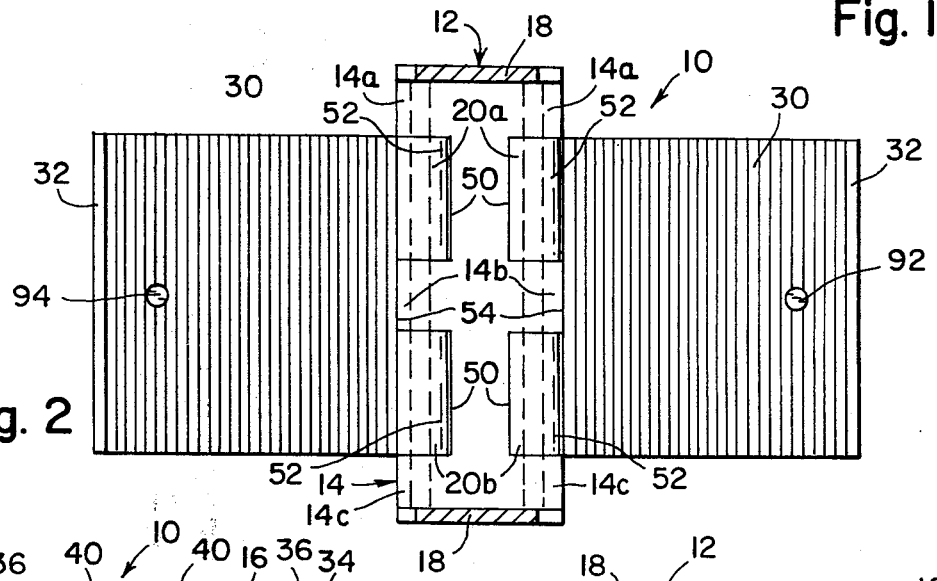
Fig. 2
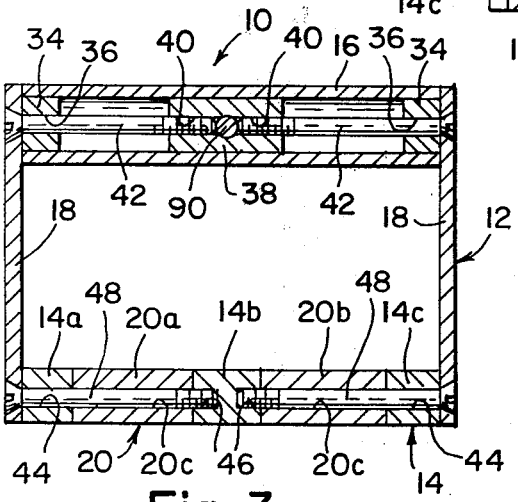
Fig. 3
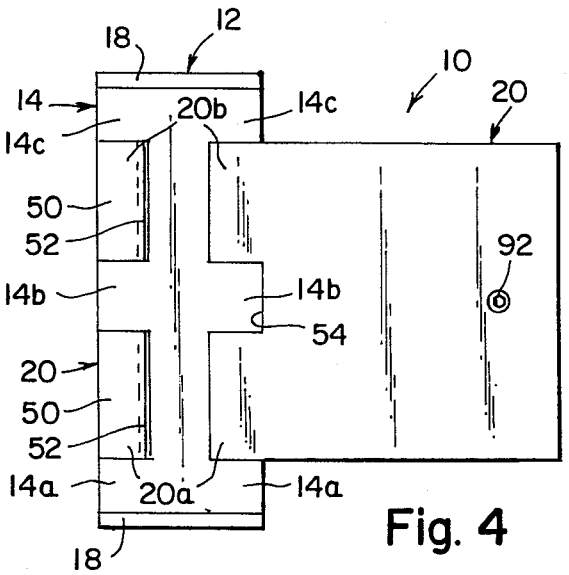
Fig. 4

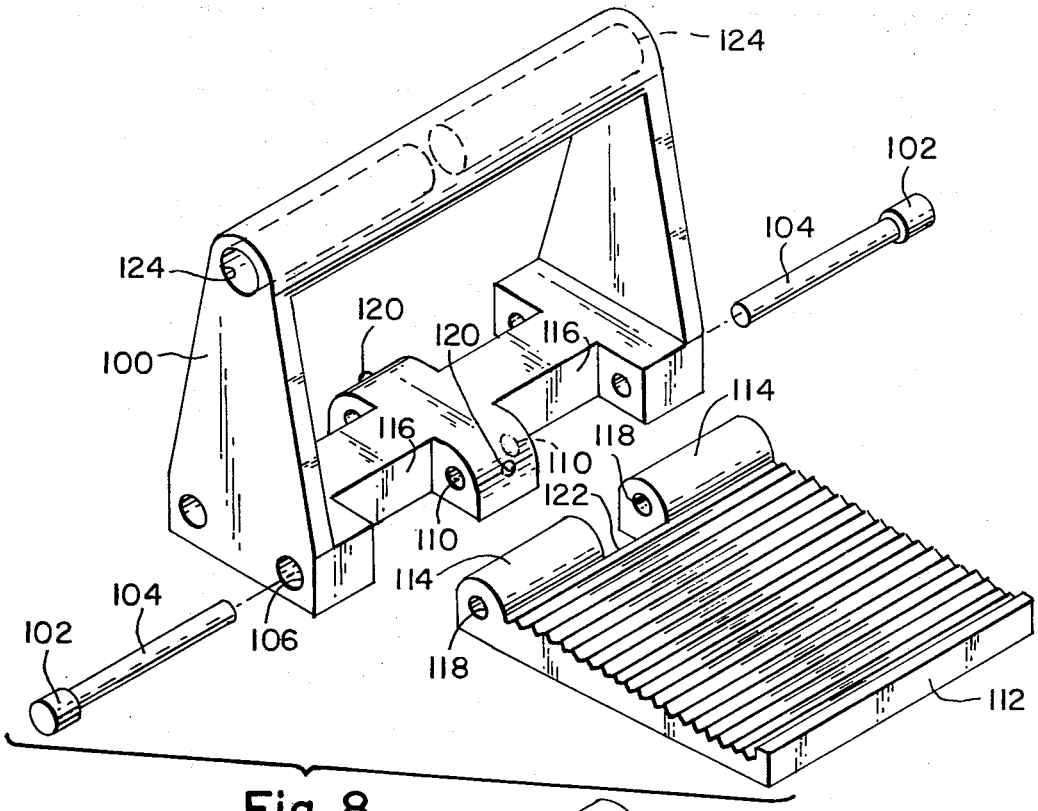
Fig. 8
Fig. 9
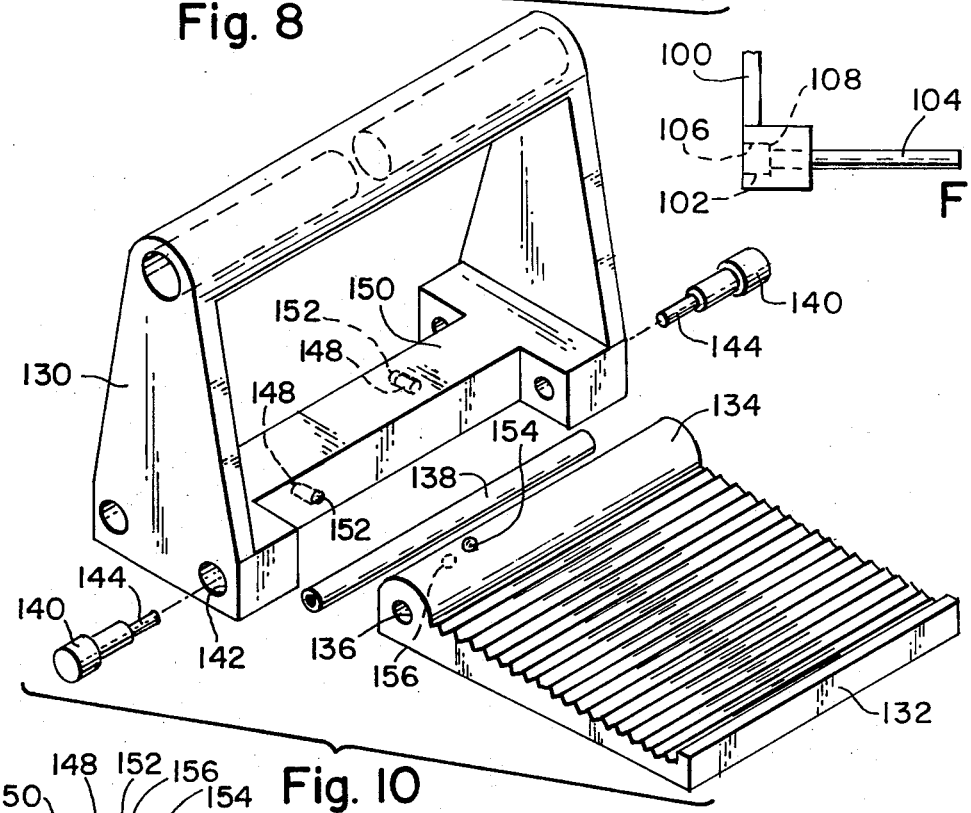
Fig. 10
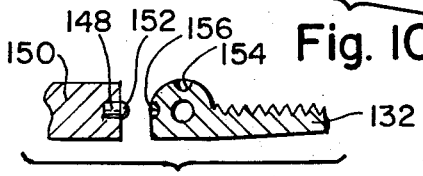
Fig. 11

AUXILIARY HANDLE FOR PLURALITY OF CARRYING HANDLES

BACKGROUND OF THE INVENTION

The invention relates to the field of hand carrying suitcases or other items which are usually provided with a carrying handle which is defined for purposes of this specification as a primary handle. Ordinarily the user would carry the suitcase or other item by the primary handle attached to it. Prior to this invention a person who is required to carry more than two such items would find difficulty in doing so since the handles of each suitcase or item are convenient for carrying one in each hand of the user. Unless the items were extremely small, it would not be practical for the user to carry more than one item with each hand. In the case of an ordinary sized suitcase, a pair of such suitcases would be most difficult to carry since the handles would be too far apart when the suitcases are side by side to permit a person to hold both handles in one hand at the same time in any practical manner. This would be especially true where the suitcases desired to be carried on one hand or by one hand would be of odd shapes or different sizes.

SUMMARY OF THE INVENTION

The present invention relates to a foldable auxiliary handle construction for the purpose of carrying several items such as two or possibly more suitcases with one hand. The item or suitcase will be provided with a primary handle for carrying it in the usual manner. The invention is embodied in a main body portion which comprises an auxiliary carrying handle connected to a base portion which is provided with foldable, wing-like extensions which serve as holding elements for a plurality of said primary handles. The holding elements may be folded upwardly toward the auxiliary handle so that the invention may be carried in a compact form or perhaps placed in a person's pocket. The holding elements may also be folded downwardly and held in place against the base portion so that a plurality of primary handles can be hung or held from them and carried by one hand holding the auxiliary handle.

In the preferred embodiment of the invention the holding elements are provided with a corrugated or rubber upper surface to provide for gripping the primary handles along a selected portion of said upper surface and in other embodiments of the invention the upper surface of the holding elements may be provided with different types of such gripping portions.

It is an object of the present invention to provide an auxiliary handle construction to enable a person to carry several suitcases or items having handle means with one hand. In this specification the term "handle means" may include the usual type of suitcase handle or any other bail type means made of any material such as wire or twine or any other material. Further objects and advantages of the present invention will be apparent from the accompanying figures of the drawings and the detailed description in the specification hereinbelow.

BRIEF DESCRIPTION OF THE DRAWINGS

FIG. 1 is a side elevation with parts cut away;

FIG. 2 is a sectional view along the lines 2—2 of FIG. 1;

FIG. 3 is a sectional view along the lines 3—3 of FIG. 1;

FIG. 4 is a bottom plan view of the invention with one of the holding elements 20 in extended position; and the other of the holding elements 20 in upwardly folded position;

FIG. 5 is a perspective detail of another embodiment of the invention;

FIG. 6 is a perspective detail of another embodiment of the invention;

FIG. 7 is a perspective detail of another embodiment of the invention;

FIG. 8 is a perspective view of another embodiment of the invention;

FIG. 9 is a detail of FIG. 8;

FIG. 10 is a perspective view of another embodiment of the invention; and

FIG. 11 is a detail taken from FIG. 10.

Similar numerals refer to similar parts throughout the several views.

DESCRIPTION OF THE PREFERRED EMBODIMENT

The preferred embodiment of the invention is illustrated in FIGS. 1 through 4 of the drawings. The invention 10 comprises a main body portion 12 having a base portion 14 and auxiliary handle 16, connector elements 18 for connecting the auxiliary handle 16 to the base portion 14, and primary handle holding elements 20 which are foldable from a first or closed position, as shown in dotted line in FIG. 1, to a second or extended position, as shown in solid line in FIG. 1. The primary handle holding elements 20 are provided to engage and hold the primary handles 22 and 24 of the suitcases 26 and 28, as shown in phantom in FIG. 1 of the drawings.

The suitcases 26 and 28 are shown for illustration purposes, it being understood that any item having a handle or bail which can be engaged or hung from a primary handle holding element 20 can be carried by the invention 10. It is also to be understood that items of different weights and sizes can be carried by the invention 10. This is illustrated in FIG. 1 by showing a larger suitcase 26 on the right side and a smaller suitcase 28 on the left side. It is further to be noted that the handle 24 of the larger suitcase is relatively close to the base portion 14 of the invention 10, whereas the handle 22 of the smaller suitcase 28 is located relatively further out on the opposite primary holding elements 20 and is, in fact, slanted to accommodate the difference in sizes between the two suitcases 26 and 28.

Thus the size of the suitcases is accommodated and also the mechanical advantage of carrying the heavier suitcase closer to base portion 14 and the lighter suitcase farther away from the base portion 14 to maintain the two primary handle holding elements in as horizontal a position as possible during the carrying. The handles 22 and 24 are assisted in maintaining their positions over the holding elements 20 by means of a gripping means 30 which, in the preferred embodiment, are a grip cover means 30 made of rubber or synthetic material having a corrugated surface as shown. The handles are further held from falling off the primary holding elements 20 by means of ends 32 which also serve as a top cover for the device when the primary handle holding elements 20 are in upwardly folded position, as shown by dotted line in FIG. 1. The auxiliary handle 16 is provided with handle end plugs 34, as shown in FIG. 3, each having a central opening 36 as well as a center plug 38 which has threaded portions 40 at its center. Screws 42 are provided to fit through connector elements 18 through the central openings 36 and to be threaded into the threaded portions 40 of center plug 38 to complete the construction of the upper portion of the invention 10.

The construction of the lower portion of the invention 10 comprises fitting the base portion 14 and the primary holding elements 20 together at the lower portions of the connector elements 18. The base portion may be made of a block of aluminum or steel in oblong form from which four sections have been recessed by any manner known to the art to provide a base 14, when viewed from above or below, in the form of a pair of "E"s back to back having extensions on both sides 14*a*, 14*b* and 14*c*. Primary handle holding elements 20 are similarly made from aluminum or steel having a cut out portion to provide a plurality of ends 20*a* and 20*b*. The ends 20*a* and 20*b* are designed to fit between the extensions 14*a*, *b* and *c* of the E shaped elements of base portion 14, as shown in FIGS. 2, 3 and 4 of the drawings. Portions 14*a* and 14*c* have center openings 44 and portion 14 has threaded portions 46. The openings 44 and threaded portions 46 accommodate screws 48 which complete the construction of the lower portion of the invention as illustrated in FIGS. 2, 3 and 4.

The primary handle holding elements 20 may be rotated at their openings 20*c* by moving primary handle holding elements from first to second position, as shown in FIG. 1, by rotating same around the shafts of screws 48 at the 20*c* openings which are in the ends 20*b* of elements 20. This may be seen by viewing shaft 48*a* of the screw illustrated in the lower right hand portion of the base 14, as shown in the cut out portion in FIG. 1 of the drawings. The cut out is made to eliminate part 14*c* of the base portion 14 so that a side plan of element 20 is shown with its opening 20*c* which can be pivoted around screw shaft 48*a*. Elements 20 also have flat end portions 50 and curved end portions 52. Thus when element 20 is in extended position, as shown in FIG. 1, flat end portion 50 fits flush against the base portion 14 as shown. This maintains element 20 in extended position in a firm and secure manner. When it is desired to fold element 20 upwardly the curved portion 52 will clear base portion 14 to permit the upward folding operation. In a similar manner end 54 of the recess in end 20*a* of element 20 fits against the extending side of element 14*b* of base portion 14 when the element 20 is in second or extended position.

End 54 within the cut out portion between ends 20*a* and 20*b*, which also support primary handle holding elements when in extended position, will also have either beveled or curved portions so that ends 54 can bear elements 14*b* of base portion 14 when moving from folded to extended position to bear against the ends of elements 14*b* when in extended position.

In FIG. 5 of the drawings an alternate form of primary handle holding element 60 is shown. FIG. 5 is a detail showing the difference between holding element 20, as shown in FIG. 1 with its gripping means 30, and element 60 with an alternate gripping means 62. Gripping means 62 are a number of projections coming upwardly from holding element 60, designed to hold a primary handle such as handle 22 or 24 along a selected portion of element 60. In FIG. 6 another alternate form of primary handle holding element is shown designated by reference numeral 70. In this form the handle gripping means 72 are in the form of upraised strips running along the upper width of the holding element 70.

Another alternate form of primary handle holding element is shown in FIG. 7, designated by reference numeral 80. In this case the material of the holding element 80 has an upper surface of ridges 82 which serve as the handle gripping means. Thus, the gripping means may be applied as in FIG. 1 with a separate resilient element, such as corrugated element 30, or may be made integrally with the primary handle holding elements out of the same metal or material of said elements, or may be made in various combinations as shown in FIGS. 1, 5, 6 and 7.

A magnet 90 is placed through the center of the handle and center plug 38. Nuts inserts 92 and 94 are placed so that they will be at the upper surfaces of holding elements 20 to be attracted by the magnet 90 on either side of the handle when the elements 20 are in folded position as shown in dotted line in FIG. 1. Inserts 92 and 94 should be of steel or other material which will be attracted by a magnet.

In FIG. 8 an alternate form of construction is shown in which the main frame may be molded of one piece of aluminum or other material such as a high impact plastic. In FIG. 8 the main body portion 100 is almost identical in shape and function to the main body portion 12 described hereinabove, the main difference, of course, being that it is of one piece construction. Another difference is the provision of stepped pins 102 which have shafts 104. The pins 102 are fitted into opening 106 which have seats or shoulders 108. The end of each shaft 104 fits into an opening 110, as indicated in FIG. 8 of the drawings. Thus, handle holding elements 112 which are similar to holding elements 20 are fitted to the main body portion by placing the inner ends 114 in recesses 116 and then running shafts 104 through openings 118 until their ends fit in openings 110, then switching the step pins 102 in place with the handle holding elements 112 pivotally attached to the main body portion 100. In this construction the handle holding elements are held in first or upward position by means of bullet locks which are placed in a central position on the bottom of the main frame, as shown in FIG. 8, so that the bullet portion will be extended past edge 122 of handle holding element 112 when it is in upward position. The bullet portion of lock 120 will also be extended beyond edge 122 when handle holding element 112 is placed in extended or second position. The force of moving from first to second position will depress the bullet portion of lock 120 under edge 122. After edge 122 has passed over the bullet lock the bullet will extend and hold it in place in second position. Thus the magnet arrangement made up of elements 90, 92 and 94 are replaced in the form of invention shown in FIG. 8 by the bullet lock arrangement placed immediately along the curve of the center of the bottom portion of the frame 100. In order to save material and to lighten the main body portion 100 openings 124 may be molded into the one piece construction.

Another form of invention is shown in FIG. 10 of the drawings which is substantially similar to the form shown in FIG. 8 except that the center support section of the main body portion 100 is eliminated. The main body portion 130 shown in FIG. 10 is made of one piece as the main body portion 100 is. The handle holding elements 132 are provided with an end 134 which runs the full length of the element 132 and has a center opening 136 into which a cylindrical hinge pin 138 may be fitted.

Step pins 140 may be fitted through openings 142 with the pin shafts 144 adapted to fit into the hollow opening 146 of the cylindrical hinge pins. Step pins 140 are thus fitted and switched into place, thereby holding the handle holding elements 132 in pivotal arrangement in accordance with the invention. In this form of the invention bullet locks or stops are placed, as at reference numerals 148, on either side of the bottom 150 of the main body portion 130, as can be seen in both FIGS. 10 and 11. Particular reference to FIG. 11 detail will show that the bullet portion 152 faces bullet recess 156 when handle holding element 132 is in second or extended position and it follows that bullet recess 154 will face bullet portion 152 when the handle holding element 132 is in the upward or first position. Thus, the bullet locks 148 serve to hold the handle holding portion 132 both in the first or upward position and in the second or extended position.

Aside from the aforementioned difference in construction of the preferred forms of the invention, they all operate in substantially the same way.

While the invention has been described in its preferred forms, there are other forms it may take. For example, steel and aluminum have been mentioned as materials for the main body portion. The main body portion may be made of any suitable material, whether it be synthetic or metal or a natural product. It is therefore desired to be protected for all forms coming within the claims hereinbelow.

What is claimed is:

1. An auxiliary handle construction for selective use in carrying a plurality of items comprising primary handles: comprising, a main body portion comprising auxiliary handle, base and connector elements, and holding elements for holding a plurality of said primary handles, in which the holding elements are movable from a first to a second position selectively, the movable holding elements comprise a flat end portion, and the base element comprises at least one flat portion, whereby at least one holding element flat portion and at least one base element flat portion are in faced contacting relation when at least one holding element is in second position.

2. The auxiliary handle construction as claimed in claim 1, in which the base is formed with at least one recessed portion to accommodate at least one end portion of a holding element, said portions being pivotally connected.

3. The auxiliary handle construction as claimed in claim 1, in which the holding element end portion further comprises a curved portion to cooperate with said base portion to provide for selective moving of said holding element portion from first to second position.

4. The auxiliary handle construction as claimed in claim 3, in which the holding element is pivotally connected to the base by connecting pin means.

5. The auxiliary handle construction as claimed in claim 4, in which the connecting pin means is the shaft of fastening means which is placed through the base and the holding element.

6. The auxiliary handle construction as claimed in claim 4, in which the auxiliary handle comprises a handle member between a pair of said connector elements in spaced relation to and above said base.

7. The auxiliary handle construction as claimed in claim 6, in which the auxiliary handle is connected to said connector elements by means of at least one plug and at least one screw.

8. The auxiliary handle construction as claimed in claim 7, in which the auxiliary handle is connected to said connector elements by means of a central plug having threaded portions and a pair of screws connecting said connector elements to said central plug.

9. The auxiliary handle construction as claimed in claim 6, in which the base is in the shape of a pair of "E"s back to back and the holding elements each have a pair of ends which fit within the spaces between the "E" extensions.

10. The auxiliary handle construction as claimed in claim 6, in which the base has a plurality of recesses to accommodate extending ends of a pair of holding elements.

11. The auxiliary handle construction as claimed in claim 6, in which the main body portion is made of one piece of material.

* * * * *